US008212638B2

(12) United States Patent
Pandey et al.

(10) Patent No.: US 8,212,638 B2
(45) Date of Patent: Jul. 3, 2012

(54) ELECTROMAGNET FOR AN ELECTRICAL CONTACTOR

(75) Inventors: Kamal Pandey, Uttarakhand (IN); Avijit Saha, West Bengal (IN); Kalyana Sundaram, Karnataka (IN); Subramanion Nagarajan, Tamil Nadu (IN)

(73) Assignee: General Electric Company, Schenectady, NY (US)

( * ) Notice: Subject to any disclaimer, the term of this patent is extended or adjusted under 35 U.S.C. 154(b) by 405 days.

(21) Appl. No.: 12/331,814

(22) Filed: Dec. 10, 2008

(65) Prior Publication Data

US 2010/0141364 A1 Jun. 10, 2010

(51) Int. Cl.
*H01H 67/02* (2006.01)

(52) U.S. Cl. ..... 335/132; 335/131

(58) Field of Classification Search ..... 335/126, 335/131, 132, 133

See application file for complete search history.

(56) References Cited

U.S. PATENT DOCUMENTS

| | | | | |
|---|---|---|---|---|
| 3,361,997 | A * | 1/1968 | Freeman, Jr. | 335/126 |
| 4,345,225 | A * | 8/1982 | Lemmer | 335/132 |
| 4,725,801 | A * | 2/1988 | Snyder | 335/125 |
| 5,014,027 | A * | 5/1991 | Ootsuka | 333/132 |
| 5,075,660 | A * | 12/1991 | Ootsuka | 335/131 |
| 5,680,083 | A | 10/1997 | Kogawa et al. | |
| 6,308,667 | B1 * | 10/2001 | Tsai et al. | 123/90.11 |
| 7,157,995 | B2 * | 1/2007 | Nishida et al. | 335/126 |

FOREIGN PATENT DOCUMENTS

| | | | |
|---|---|---|---|
| EP | 0081604 | A1 | 6/1983 |
| FR | 2406885 | A1 | 5/1979 |
| FR | 2566571 | A1 | 12/1985 |

OTHER PUBLICATIONS

English Abstract for FR2406885; Publication date: May 18, 1979; 1 pg.
English Abstract for FR2566571; Publication date: Dec. 27, 1985; 1 pg.
English Abstract for EP0081604; Publication date: Jun. 22, 1983; 1 pg.
EP Search Report for Application No. 09177148.5; Date of Mailing: Mar. 24, 2010; 6 pgs.

* cited by examiner

*Primary Examiner* — Anh Mai
*Assistant Examiner* — Alexander Talpalatskiy
(74) *Attorney, Agent, or Firm* — Cantor Colburn LLP

(57) ABSTRACT

An electrical contactor includes a moveable core member having a first moveable core surface and a second movable core surface. The second moveable core surface is angled relative to the first moveable core surface. A stationary core member is mounted relative to the moveable core member. The stationary core member includes a pole arm having a first stationary core surface and a second stationary core surface. The second stationary core surface is angled relative to the first stationary core surface. In response to a magnetic field traversing a path defined by the stationary core member and the moveable core member, the first stationary core surface is magnetically biased to mate with the first moveable core surface and the second stationary core surface is magnetically biased to mate with the second moveable core surface to bring into contact an electrical contact member and an electrical contact element.

13 Claims, 4 Drawing Sheets

ELECTROMAGNET FOR AN ELECTRICAL CONTACTOR

BACKGROUND

Exemplary embodiments of the present invention relate to the art of electrical switching devices and, more particularly, to an electromagnet for a direct current (DC) control contactor.

Electrical contactors utilize an electromagnet to move contacts between open and closed positions. More specifically, contactors include a movable contact portion coupled to a movable core, a stationary contact portion and a stationary core. The stationary core is energized to attract the movable core and thus bring together the stationary contact portion and movable contact portion. The movable and stationary cores are configured to ensure proper opening and closing forces for the contacts. As electrical contactors are reduced in size, the movable cores are forced to be made smaller. Regardless, the need to maintain proper opening and closing forces remains. Many current compact electrical contactors utilize a stationary core having a two-pole arm design. Two-pole cores contain windings on each pole having opposite polarities to reduce size and cost.

BRIEF DESCRIPTION OF THE INVENTION

In accordance with an exemplary embodiment of the invention, an electrical contactor includes a frame, and a stationary contact portion mounted to the frame. The stationary contact portion includes at least one electrical contact member. A moveable contact portion is selectively shiftable relative to the stationary contact portion. The moveable contact portion includes at least one electrical contact element. A moveable core member is mounted to the moveable contact portion. The moveable core member includes a first moveable core surface and a second movable core surface. The second moveable core surface is angled relative to the first moveable core surface. A stationary core member is mounted to the frame. The stationary core member includes a pole arm having a first stationary core surface and a second stationary core surface. The second stationary core surface is angled relative to the first stationary core surface. In response to a magnetic field traversing a path defined by the stationary core member and the moveable core member, the first stationary core surface is magnetically biased to mate with the first moveable core surface and the second stationary core surface is magnetically biased to mate with the second moveable core surface to bring into contact the at least one electrical contact member and at least one electrical contact element.

In accordance with another exemplary embodiment of the invention, a method of operating an electrical contactor includes energizing a stationary core member having a pole arm including a first stationary core surface and a second stationary core surface. The second stationary core surface is angled relative to the first stationary core surface. The method also includes attracting a moveable core member towards the stationary core member. The moveable core member includes a first moveable core surface configured to mate with the first stationary core surface, and a second moveable core surface configured to mate with the second stationary core surface. The method further includes shifting a moveable contact portion towards a stationary contact portion to bring together at least one electrical contact member and at least one electrical contact element.

In accordance with yet another exemplary embodiment of the invention, an electromagnet for an electrical contactor includes a moveable core member including a first moveable core surface and a second movable core surface. The second moveable core surface is angled relative to the first moveable core surface. The electrical contactor further includes a stationary core member including a pole arm having a first stationary core surface and a second stationary core surface. The second stationary core surface is angled relative to the first stationary core surface. In response to a magnetic field traversing a path defined by the stationary core member and the moveable core member, the first stationary core surface is magnetically biased to mate with the first moveable core surface and the second stationary core surface is magnetically biased to mate with the second moveable core surface to bring into contact the at least one electrical contact member and at least one electrical contact element.

DETAILED DESCRIPTION OF THE INVENTION

Figure 1:
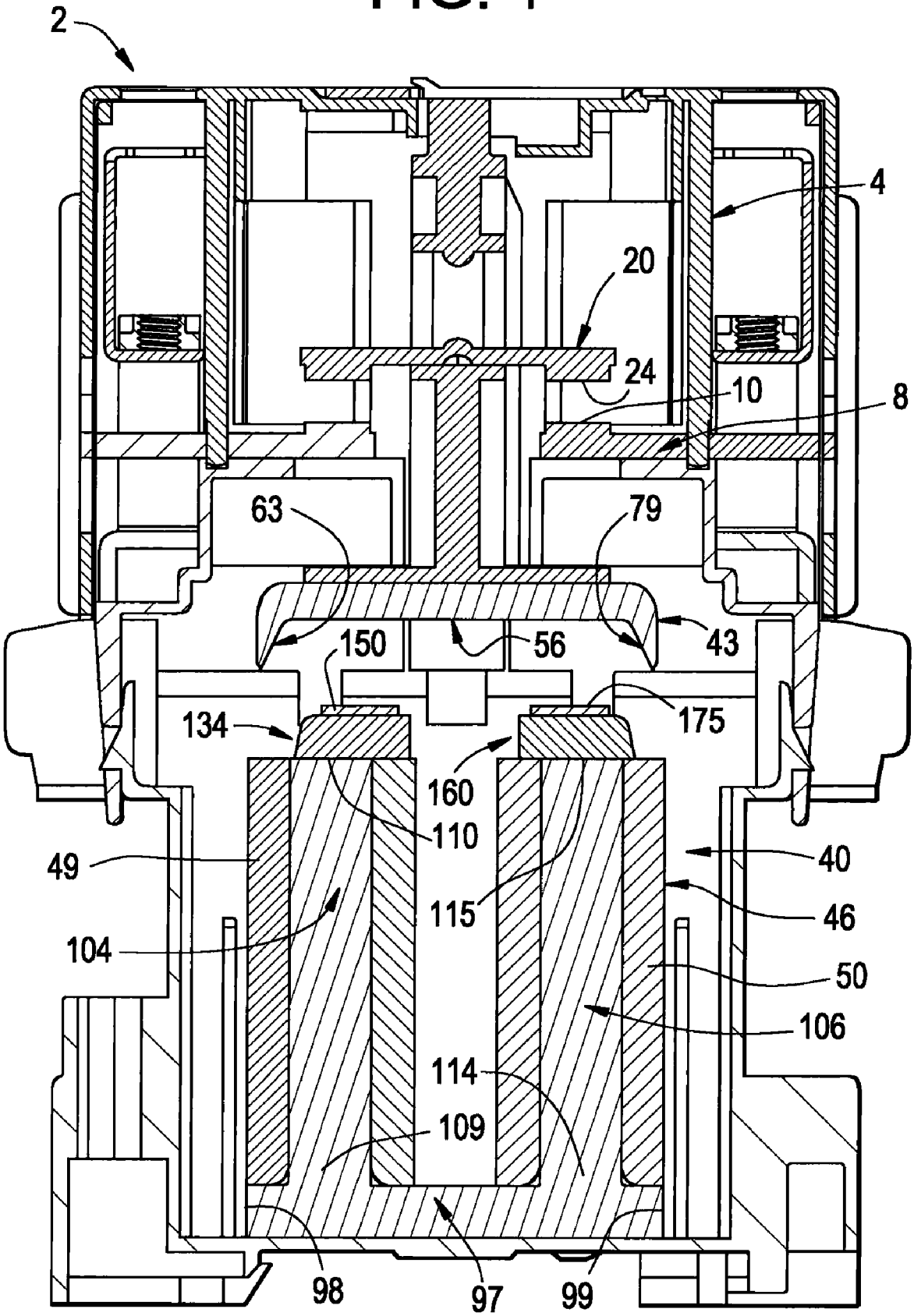
FIG. 1 is a cross-sectional side view of an electrical contactor including an electromagnet constructed in accordance with exemplary embodiments of the invention.

With reference to FIG. 1, an electrical contactor constructed in accordance with exemplary embodiments of the invention is indicated generally at 2. Contactor 2 includes a frame 4 that supports a stationary contact portion 6 having a plurality of electrical contact member 10, and a moveable contact portion 20 having a plurality of electrical contact elements 24. Contactor 2 is also show to include an electromagnet 40 that, in response to a magnetic field flowing through the electromagnet shifts moveable contact portion 20 toward stationary contact portion 6 to selectively engage and disengage electrical contact members 10 and electrical contact element 24. That is, contactor 2 includes both normally open (NO) and normally closed (NC) contacts that are selectively closed and opened respectively when through electromagnet 40 is magnetically energized.

Figure 2:
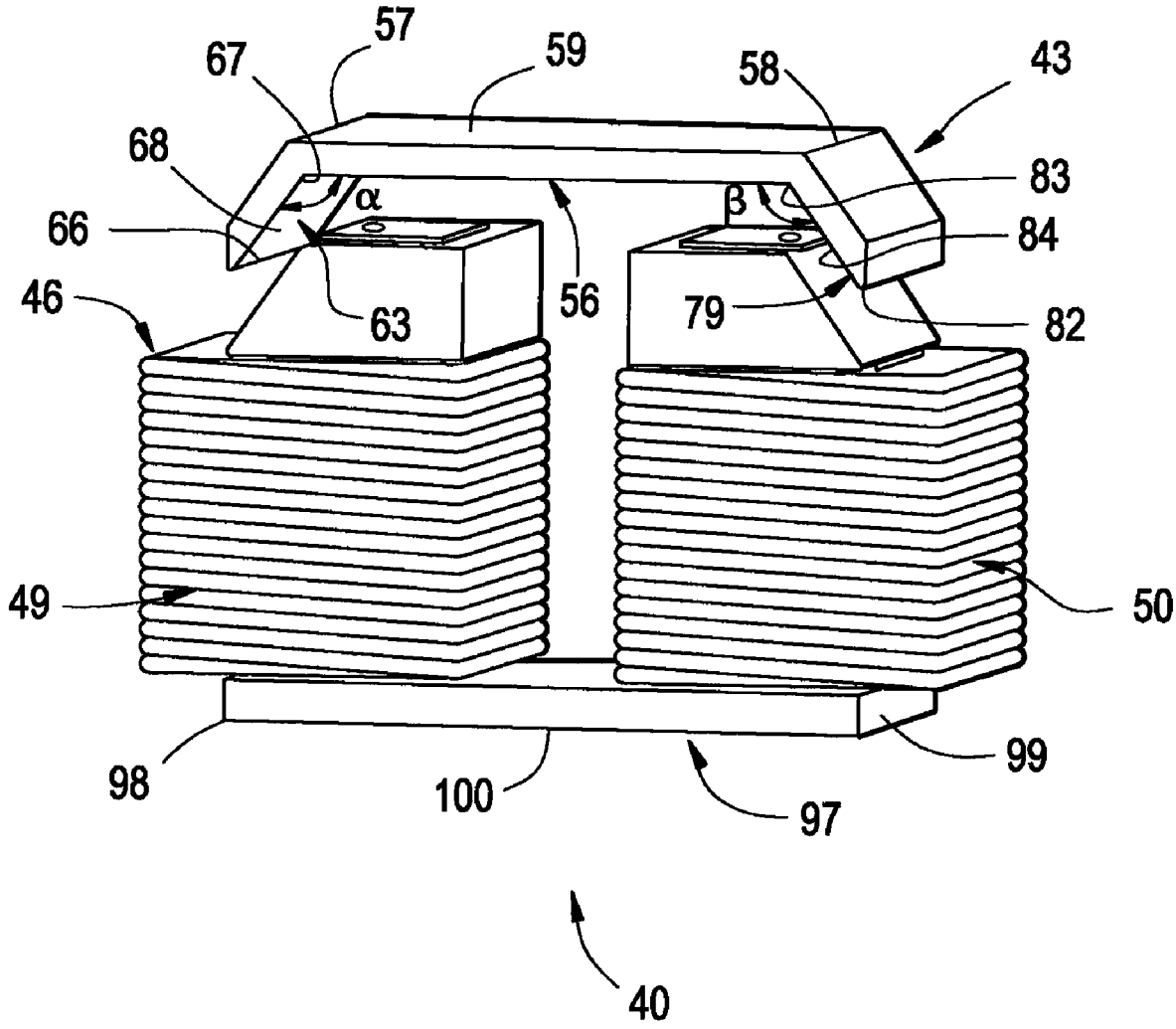
FIG. 2 is a perspective view of the electromagnet of FIG. 1.

In accordance with an exemplary embodiment of the invention, electromagnet 40 includes a moveable core member 43 and a stationary core member 46 provided with first and second wire coils 49 and 50. As best shown in FIG. 2, moveable core member 43 includes a first moveable core surface 56 having a first end 57 that extends to a second end 58 through an intermediate portion 59. Moveable core member 43 also includes a second moveable core surface 63 having a first end 66 that extends from first end 57 of first moveable core surface 56 to a second end 67 through an intermediate portion 68. Second moveable core surface 63 extends at an angle $\alpha$ relative to first moveable sore surface 56. Moveable core member 43 is further shown to includes a third moveable core surface 79 having a first end 82 that extends from second end 58 of first moveable core surface 56 to a second end 83 through an intermediate portion 84. Third moveable core surface 79 extends at an angle $\beta$ relative to first moveable sore surface 56. In the exemplary embodiment shown angle $\beta$ is substantially similar to angle $\alpha$.

Figure 3:
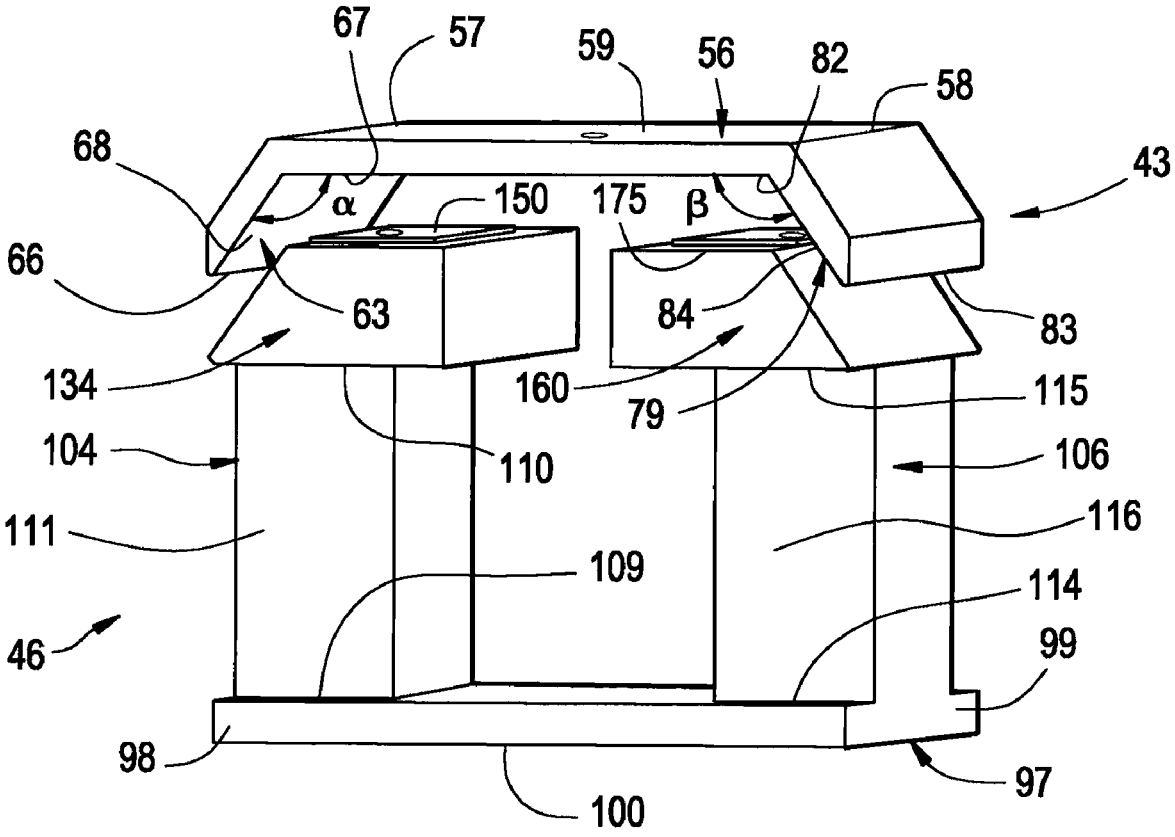
FIG. 3 is a perspective view of a stationary core member and moveable core member of the electromagnet of FIG. 2; an FIG. 4 is an exploded view of the stationary core member of FIG. 3.
Figure 4:
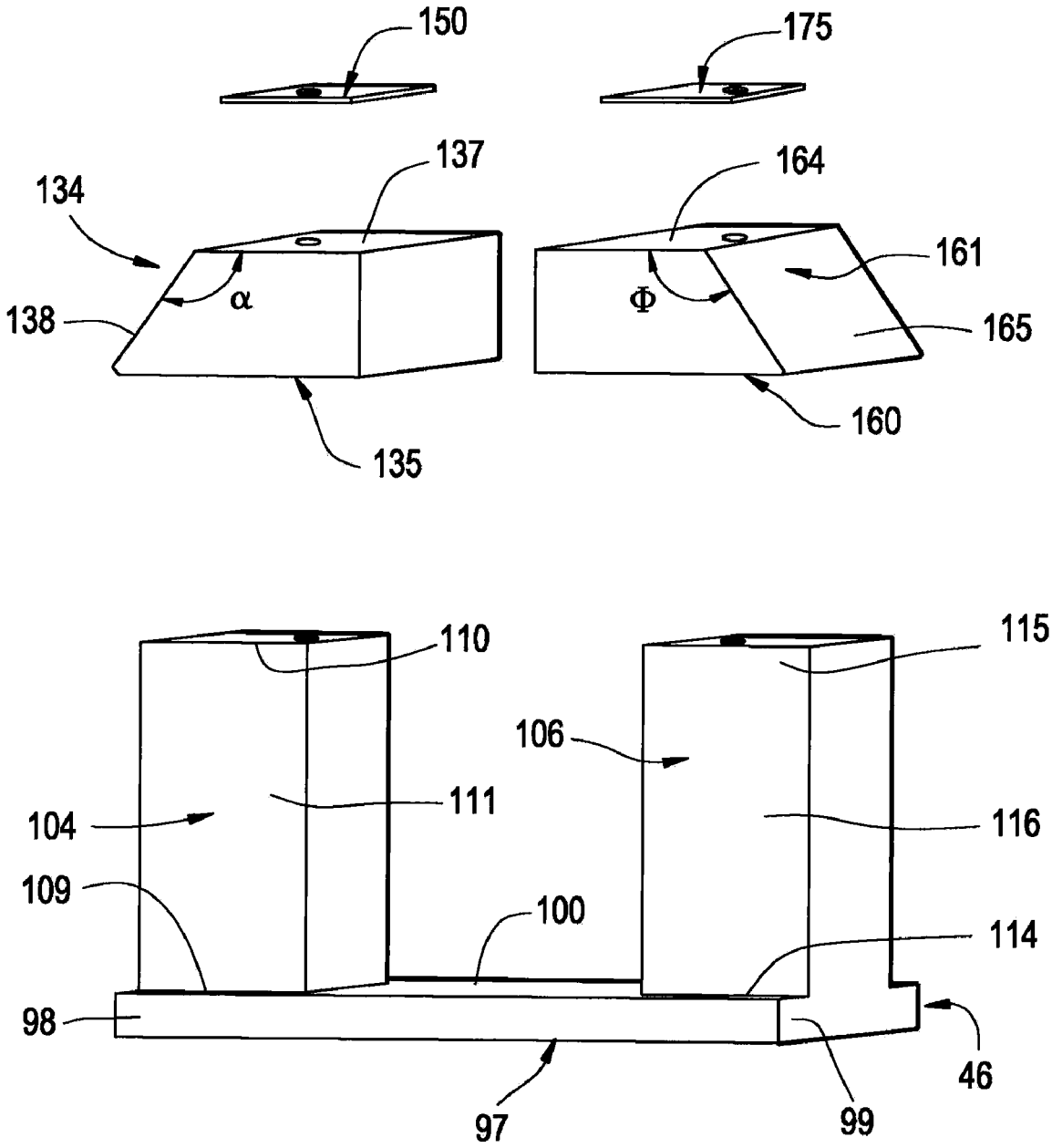

Reference will now be made to FIGS. 3-4 in describing stationary core member 46 constructed in accordance with an exemplary embodiment of the invention. As shown, stationary core member 46 includes a base member 97 including a first end section 98 that extends to a second end section 99 through an intermediate section 100. Stationary core member 46 is also shown to include a first pole arm 104 positioned at first end section 98 and a second pole arm 106 positioned at second end portion 99. First pole arm 104 includes a first end 109 that extends from first end section 98 to a second end 110 through an intermediate or coil zone 111. Similarly, second pole arm 106 includes a first end 114 that extends from second end section 99 to a second end 115 through an intermediate or coil zone 116.

In further accordance with the embodiment shown, stationary core member 46 includes a first pole piece 134 mounted at second end 110 of first pole arm 104. First pole piece 134 includes a main body 135 that defines a first stationary core surface 137 and a second stationary core surface 138. Second stationary core surface 138 extends from first stationary core surface 137 at an angle δ. As will become apparent below, angle δ corresponds to angle α of second moveable core surface 63. First stationary core surface 137 is provided with a spacer 150 that is configured to reduce remnant flux density between stationary core member 46 and moveable core member 43 upon de-energization of contactor 2.

Stationary core member 46 further includes a second pole piece 160 having a main body 161 that defines a third stationary core surface 164 and a fourth stationary core surface 165. Fourth stationary core surface 165 extends from third stationary core surface 164 at an angle ϕ. Angle ϕ corresponds to angle β of third moveable core surface 79. Third stationary core surface 164 is provided with a spacer 175 that is configured to reduce remnant flux density between stationary core member 46 and moveable core member 43 upon de-energization of contactor 2. The angled core surfaces, i.e., second and third moveable core surfaces 63, 79 and second and fourth stationary core surfaces 138, 165 enhance the performance of electromagnet 40 without an requiring a size increase.

In response to a magnetic field traversing a path defined by stationary core member 46 and the moveable core member 43 first stationary core surface 137 is magnetically biased to mate with first moveable core surface 56, second stationary core surface 138 is magnetically biased to mate with second moveable core surface 63, third stationary core surface 164 is magnetically biased to mate with first moveable core surface 56 and fourth stationary core surface 165 is magnetically biased to mate with third moveable core surface 79 to bring into contact electrical contact member 10 and electrical contact element 24. In this manner, the angled core surfaces contribute to the construction of a compact contactor with opening/closing forces that are comparable to larger contactors. That is, the angled core surfaces ensure a low reluctance path that increases useful magnetic flux, which, in turn, enhances magnetic force. Furthermore, the angled core surfaces provide enhanced vibration and shock resistance. Finally, it should be understood that angles α, β, δ, and ϕ can vary in accordance with exemplary embodiments of the invention In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

The invention claimed is:

1. An electrical contactor comprising:

a frame;

a stationary contact portion including at least one electrical contact member;

a moveable contact portion selectively shiftable relative to the stationary contact portion, the moveable contact portion including at least one electrical contact element;

a moveable core member mounted to the moveable contact portion, the moveable core member including a first moveable core planar surface and a second movable core planar surface, the second moveable core planar surface being angled relative to the first moveable core planar surface; and a stationary core member mounted to the frame, the stationary core member including a pole arm having a first stationary core planar surface and a second stationary core planar surface, the second stationary core planar surface being angled relative to the first stationary core planar surface, the at least one contact member being mounted to one of the first and second stationary core planar surfaces, where in response to a magnetic field traversing a path defined by the stationary core member and the moveable core member, the first stationary core planar surface is magnetically biased to mate with the first moveable core planar surface and the second stationary core planar surface is magnetically biased to mate with the second moveable core planar surface to bring into contact the at least one electrical contact member and at least one electrical contact element.

2. The electrical contactor according to claim 1, further comprising: a spacer mounted to the first stationary core planar surface, the spacer being disposed and configured to reduce remnant flux density between the stationary core member and the moveable core member in response to cessation of the magnetic field traversing the path defined by the stationary core member and the moveable core member.

3. The electrical contactor according to claim 1, wherein the moveable core member includes a third moveable core planar surface angled relative to the first moveable core planar surface.

4. The electrical contactor according to claim 3, further comprising: another pole arm, the another pole arm including a third stationary core planar surface and a fourth stationary core planar surface, the fourth stationary core planar surface being angled relative to the third stationary core planar surface, where in response to a magnetic field traversing a path defined by the stationary core member and the moveable core member, the third stationary core planar surface mates with the first moveable core planar surface and the fourth stationary core planar surface mates with the third moveable core planar surface to bring into contact the at least one electrical contact member and at least one electrical contact element.

5. The electrical contactor according to claim 4, further comprising: a spacer mounted to the third stationary core planar surface, the spacer being disposed and configured to reduce remnant flux density between the stationary core member and the moveable core member in response to a cessation of the magnetic field traversing the path defined by the stationary core member and the moveable core member.

6. A method of operating an electrical contactor comprising:

energizing a stationary core member having a pole arm including a first stationary core planar surface and a second stationary core planar surface, the second stationary core planar surface being angled relative to the first stationary core planar surface;

attracting a moveable core member towards the stationary core member, the moveable core member including a first moveable core planar surface configured to mate with the first stationary core planar surface, and a second moveable core planar surface configured to mate with the second stationary core planar surface; and shifting a moveable contact portion towards a stationary contact portion mounted to one of the first and second stationary core planar surfaces to bring together at least one electrical contact member and at least one electrical contact element.

7. An electromagnet for an electrical contactor comprising:

a moveable core member including a first moveable core planar surface and a second movable core planar surface, the second moveable core planar surface being angled relative to the first moveable core planar surface; and a stationary core member including a pole arm having a first stationary core planar surface and a second stationary core planar surface, and at least one contact member mounted to one of the first and second stationary core planar surfaces, the second stationary core planar surface being angled relative to the first stationary core planar surface, where in response to a magnetic field traversing a path defined by the stationary core member and the moveable core member, the first stationary core planar surface is magnetically biased to mate with the first moveable core planar surface and the second stationary core planar surface is magnetically biased to mate with the second moveable core planar surface to bring into contact the at least one electrical contact member and at least one electrical contact element.

8. The electromagnet for an electrical contactor according to claim 7, further comprising: a spacer mounted to the first stationary core planar surface, the spacer being disposed and configured to reduce remnant flux density between the stationary core member and the moveable core member in response to a cessation of the magnetic field traversing the path defined by the stationary core member and the moveable core member.

9. The electromagnet for an electrical contactor according to claim 7, wherein the moveable core member includes a third moveable core planar surface angled relative to the first moveable core surface.

10. The electromagnet for an electrical contactor according to claim 9, further comprising: another pole arm, the another pole arm including a third stationary core planar surface and a fourth stationary core planar surface, the fourth stationary core planar surface being angled relative to the third stationary core planar surface, where in response to a magnetic field traversing a path defined by the stationary core member and the moveable core member, the third stationary core planar surface mates with the first moveable core planar surface and the fourth stationary core planar surface mates with the third moveable core planar surface to bring into contact the at least one electrical contact member and at least one electrical contact element.

11. The electromagnet for an electrical contactor according to claim 10, further comprising: a spacer mounted to the third stationary core planar surface, spacer being disposed and configured to reduce remnant flux density between the stationary core member and the moveable core member in response to a cessation of the magnetic field traversing the path defined by the stationary core member and the moveable core member.

12. The contactor according to claim 1, wherein the second stationary core planar surface arranged at an angle greater than zero degrees relative to the first stationary core planar surface.

13. The electromagnet for an electrical contactor according to claim 7, wherein the second stationary core planar surface arranged at an angle greater than zero degrees relative to the first stationary core planar surface.

* * * * *